US012569059B2

(12) United States Patent
Zebarjad et al.

(10) Patent No.: US 12,569,059 B2
(45) Date of Patent: Mar. 10, 2026

(54) WORKSTATION WITH TILT-ADJUSTABLE TABLETOP

(71) Applicant: Teknion Limited, Toronto (CA)

(72) Inventors: Hamid Zebarjad, Toronto (CA); Viktor Cherkashin, Toronto (CA); Jawad Majeed, Toronto (CA); Maisan Caines, Toronto (CA)

(73) Assignee: Teknion Limited, Toronto (CA)

( * ) Notice: Subject to any disclaimer, the term of this patent is extended or adjusted under 35 U.S.C. 154(b) by 132 days.

(21) Appl. No.: 18/610,890

(22) Filed: Mar. 20, 2024

(65) Prior Publication Data

US 2025/0295226 A1 Sep. 25, 2025

(51) Int. Cl.
*A47B 13/08* (2006.01)
*A47B 9/10* (2006.01)

(52) U.S. Cl.
CPC ..... *A47B 13/081* (2013.01); *A47B 9/10* (2013.01)

(58) Field of Classification Search
CPC ..... A47B 13/081; A47B 9/10; A47B 17/06; A47B 19/06; A47B 41/02; A47B 2200/0042; A47B 2200/0043
See application file for complete search history.

(56) References Cited

U.S. PATENT DOCUMENTS 5,131,333 A * 7/1992 Karasawa ..... A47B 19/06 108/1
11,284,710 B1 3/2022 Guo
11,388,990 B1 7/2022 Watkins
12,383,055 B1 * 8/2025 Yu ..... A47B 25/00
2006/0065163 A1 * 3/2006 Chi ..... A47B 21/03 108/50.01

(Continued)

FOREIGN PATENT DOCUMENTS

CN 105725588 B 1/2019
DE 202009011272 U1 4/2010

(Continued)

OTHER PUBLICATIONS

"Pneumatic Adjustable Height Desk Mobile Desk Tiltable Desktop Adjustable Standing Desk Mobile Laptop Desk Cart 29.9 inches to 44.5 inches, Maple," Oct. 21, 2021, Available: https://www.amazon.ca/Pneumatic-Adjustable-Tiltable- Desktop-Standing/dp/B09JZ1J1S2. 4 pages.

(Continued)

*Primary Examiner* — Daniel J Rohrhoff
(74) *Attorney, Agent, or Firm* — SMART & BIGGAR LP

(57) ABSTRACT

An adjustable workstation includes a tabletop having opposed upper and lower surfaces, a leg for supporting the tabletop, a gas spring having opposed spring front and rear ends, and a tabletop mount affixed to an upper end of the leg and pivotably coupled to the lower surface of the tabletop at a tilt axis. The spring front end is pivotably coupled to the lower surface of the tabletop. The spring rear end is pivotably coupled to the mount at an elevation lower than the tilt axis. The tabletop pivots in a first direction about the tilt axis upon extension of the gas spring to raise a front edge of the tabletop relative to a rear edge of the tabletop. The tabletop pivots in a second direction about the tilt axis upon retraction of the gas spring to lower the front edge of the tabletop relative to the rear edge of the tabletop.

20 Claims, 8 Drawing Sheets

(56) References Cited

U.S. PATENT DOCUMENTS

| | | | | |
|---|---|---|---|---|
| 2015/0068432 | A1* | 3/2015 | Wagner | A47B 21/0314 108/3 |
| 2017/0290415 | A1* | 10/2017 | Hsu | A47B 21/00 |
| 2022/0031064 | A1* | 2/2022 | Supriya | A47B 9/00 |
| 2023/0072848 | A1* | 3/2023 | Lu | A47B 3/002 |
| 2025/0194789 | A1* | 6/2025 | Xu | A47B 9/10 |

FOREIGN PATENT DOCUMENTS

| | | | |
|---|---|---|---|
| EP | 3639695 | A1 | 4/2020 |
| KR | 101570025 | B1 | 11/2015 |
| KR | 101716098 | B1 | 3/2017 |
| KR | 102056182 | B1 | 12/2019 |
| WO | 2023193555 | A1 | 10/2023 |

OTHER PUBLICATIONS

JOY, "JOY worker Foldable Mobile Standing Desk, Pneumatic Height Adjustable Sit Stand Desk, 90° Tiltable Rolling Laptop Desk, Portable Desk with Wheels Non-Slip Mat for Home Office, Holds Up to 22lbs, White," May 20, 2022. Avalable: https://www.amazon.ca/JOY-worker-Foldable-Pneumatic-Adjustable/dp/B09QHWVXJR. 7 pages.

* cited by examiner

WORKSTATION WITH TILT-ADJUSTABLE TABLETOP

FIELD

The teaching disclosed herein relates to workstations, and more particularly, to workstations that include tilt-adjustable tabletops.

INTRODUCTION

Workstations with adjustable tabletops are known. Such workstations are commonly used, for example, in office buildings or in home offices. The tabletops of some adjustable workstations are capable of tilt adjustments (i.e., changing the inclination of the tabletop relative to the floor). The ability to adjust the tabletop's inclination lets users select the inclination preferred for a particular task.

SUMMARY

The following summary is intended to introduce the reader to various aspects of the applicant's teaching, but not to define any invention.

According to some aspects, an adjustable workstation includes (a) a tabletop having a tabletop upper surface, a tabletop underside surface opposite the tabletop upper surface, a tabletop front edge, and a tabletop rear edge spaced rearwardly from the tabletop front edge by a tabletop depth. The adjustable workstation further includes (b) a leg for supporting the tabletop. The leg includes a leg upper end portion and a leg lower end portion. The adjustable workstation further includes (c) a tabletop mount affixed to the leg upper end portion. The tabletop mount is pivotably coupled to the tabletop underside surface at a tabletop tilt axis. The tabletop tilt axis is located rearwardly of a midpoint of the tabletop depth. The tabletop pivots relative to the tabletop mount about the tabletop tilt axis. The adjustable workstation further includes (d) a tabletop gas spring having a gas spring front end portion and a gas spring rear end portion spaced apart from the gas spring front end portion along a gas spring axis. The gas spring front end portion is pivotably coupled to the tabletop underside surface at a gas spring front axis. The gas spring rear end is pivotably coupled to the tabletop mount at a gas spring rear axis. The gas spring front axis is located forwardly of the tabletop tilt axis. The gas spring rear axis is located below the tabletop tilt axis. The tabletop is configured to pivot in a first direction of rotation about the tabletop tilt axis upon extension of the tabletop gas spring to raise the tabletop front edge relative to the tabletop rear edge. The tabletop is configured to pivot in a second direction of rotation about the tabletop tilt axis upon retraction of the tabletop gas spring to lower the tabletop front edge relative to the tabletop rear edge. The adjustable workstation further includes (e) a gas spring lock movable between a gas spring locked position, in which the gas spring lock inhibits extension and retraction of the tabletop gas spring, and a gas spring unlocked position, in which extension and retraction of the tabletop gas spring is uninhibited by the gas spring lock.

In some examples, the tabletop tilt axis is spaced forwardly of the leg upper end portion.

In some examples, the tabletop tilt axis is spaced forwardly of the tabletop rear edge by a forward offset. The forward offset is between 10% and 40% of the tabletop depth.

In some examples, the gas spring front axis is located forwardly of the midpoint of the tabletop depth.

In some examples, the tabletop gas spring is configured to exert a biasing force into extension. The biasing force assists pivoting the tabletop in the first direction of rotation to raise the tabletop front edge.

In some examples, the adjustable workstation further includes a user-operable lock release actuator coupled to the gas spring lock. The lock release actuator is mounted to the tabletop underside surface and located forwardly of the tabletop tilt axis.

In some examples, the lock release actuator is movable between a first position and second position. The lock release actuator is biased to the first position. Moving the lock release actuator from the first position to the second position moves the gas spring lock from the gas spring locked position to the gas spring unlocked position.

In some examples, the tabletop has a tabletop first side edge and a tabletop second side edge spaced laterally from the tabletop second side edge by a tabletop width, and the lock release actuator is positioned proximate the tabletop first side edge whereby the lock release actuator and a portion of the tabletop upper surface above the lock release actuator form a user hand grip for sequentially i) moving the lock release actuator from the first position to the second position and ii) supplying an upward or downward force to the tabletop to pivot the tabletop about the tabletop tilt axis with one hand.

In some examples, a midpoint of the lock release actuator is spaced forwardly of the tabletop tilt axis by an actuator offset. The actuator offset is less than 15 cm.

In some examples, the tabletop pivots between 20 and 50 degrees about the tabletop tilt axis when the gas spring is moved from a fully retracted position to a fully extended position.

In some examples, the tabletop gas spring has a spring length between the gas spring front end portion and the gas spring rear end portion, and the spring length increases by less than 10% when the first gas spring is moved from the fully retracted position to the fully extended position.

In some examples, the gas spring axis is inclined at a gas spring angle relative to the tabletop underside surface, and the gas spring angle is between 10 and 35 degrees when the tabletop gas spring is in a fully extended position.

In some examples, the gas spring angle changes by less than 15 degrees when the tabletop gas spring is moved between the fully extended position and a fully retracted position.

In some examples, the adjustable workstation further includes a cover affixed to the tabletop underside surface for concealing at least the tabletop gas spring.

In some examples, the leg includes a leg upper segment and a leg lower segment telescopically connected to the leg upper segment. The leg upper segment has the leg upper end portion. The leg lower segment has the leg lower end portion. The leg has a leg length from the leg upper end portion to the leg lower end portion. The leg upper segment is moveable relative to the leg lower segment to vary the leg length.

In some examples, the adjustable workstation further includes a leg gas spring disposed within the leg to assist with moving the leg upper segment relative to the leg lower segment.

In some examples, the gas spring rear end portion is pivotably coupled to the tabletop mount by a clevis joint, the clevis joint located at a lower elevation than the tabletop tilt axis.

In some examples, the clevis joint includes a pin that passes through a pin aperture in the gas spring rear end portion, and a clevis member fixed to and extending downwardly from a lower end of the tabletop mount. The clevis member has opposed prong openings for receiving a respective end of the pin.

In some examples, the clevis member extends forwardly and downwardly from the lower end of the mount main body.

In some examples, the tabletop has a tabletop first side edge and a tabletop second side edge spaced laterally from the tabletop first side edge by a tabletop width, and the leg has a leg axis extending centrally through the leg upper end portion and the leg lower end portion. The leg axis intersects the tabletop at a midpoint of the tabletop width.

Other aspects and features of the teachings disclosed herein will become apparent to those ordinarily skilled in the art, upon review of the following description of the specific examples of the present disclosure.

DRAWINGS

For a better understanding of the described examples and to show more clearly how they may be carried into effect, reference will now be made, by way of example, to the accompanying drawings in which.

Figure 1:
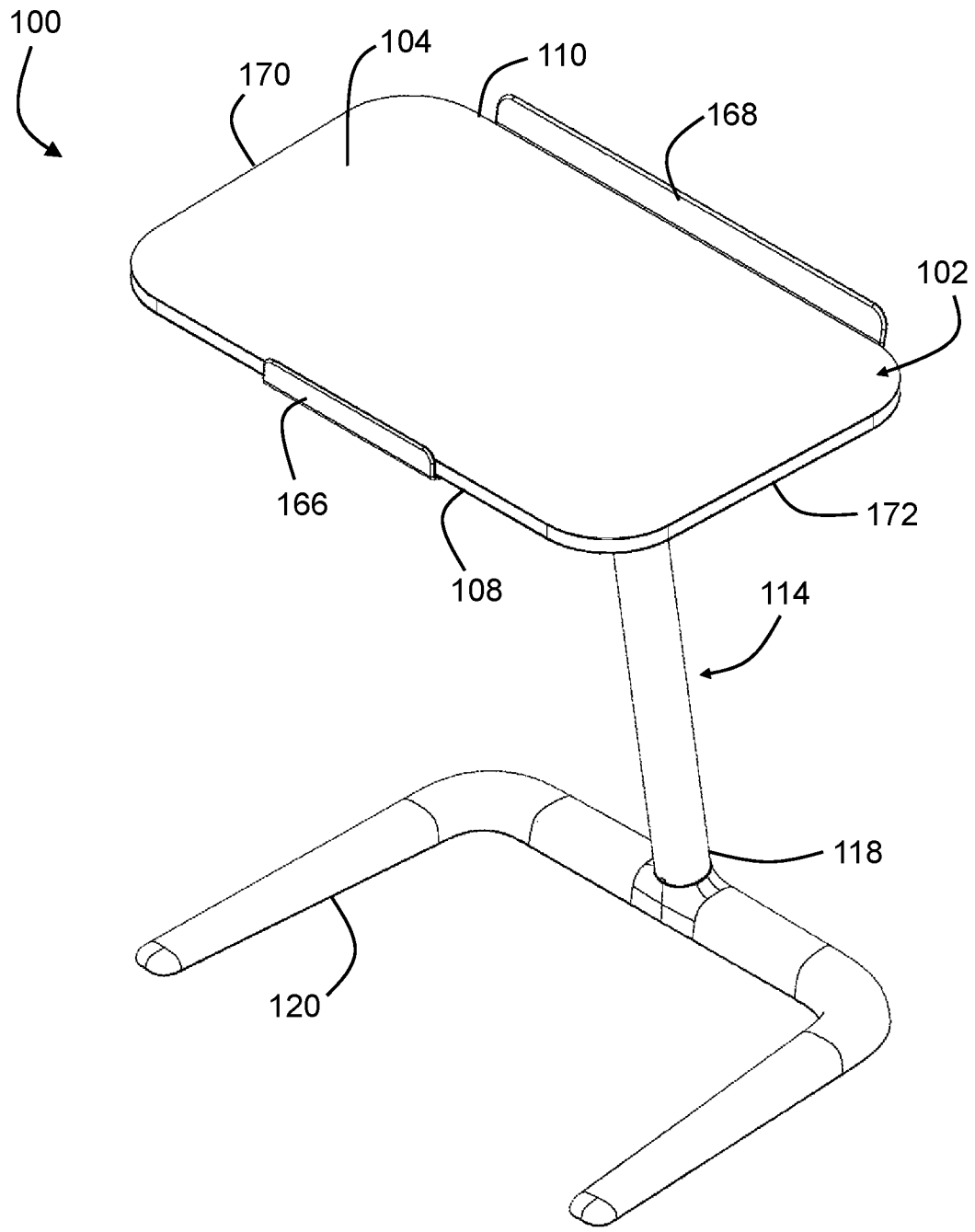
FIG. 1 is a top perspective view of an adjustable workstation according to aspects of the teaching disclosed herein.
Figure 5:
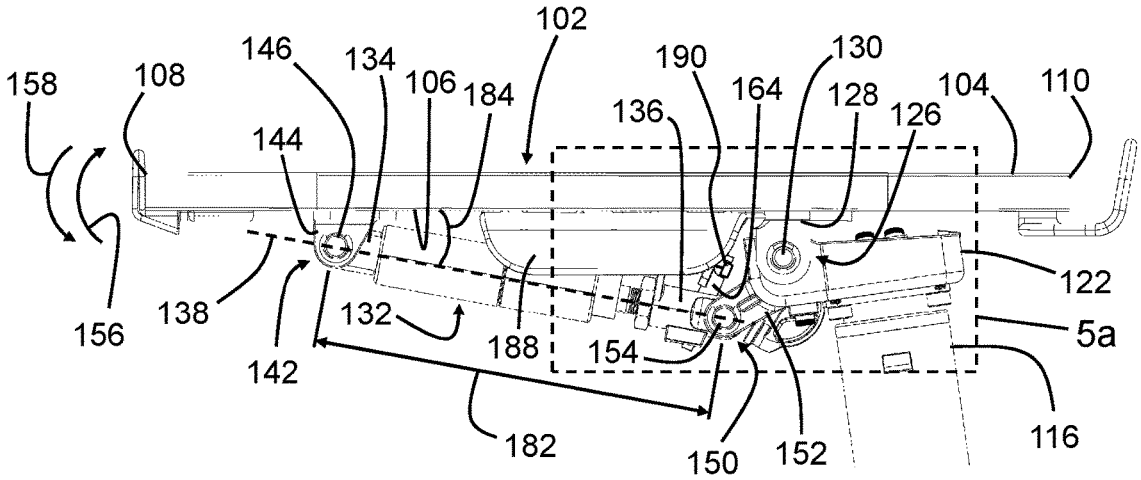
FIG. 5 is an enlarged view of a portion of the adjustable workstation identified at box 5 of FIG. 4.
Figure 5A:
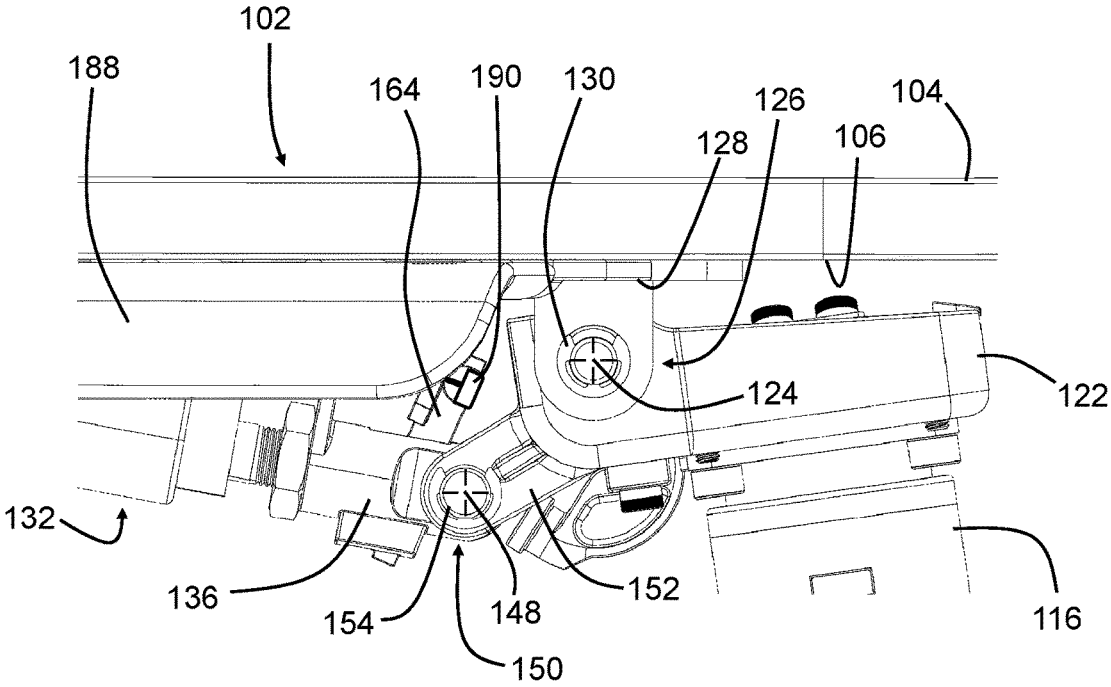
Figure 6:
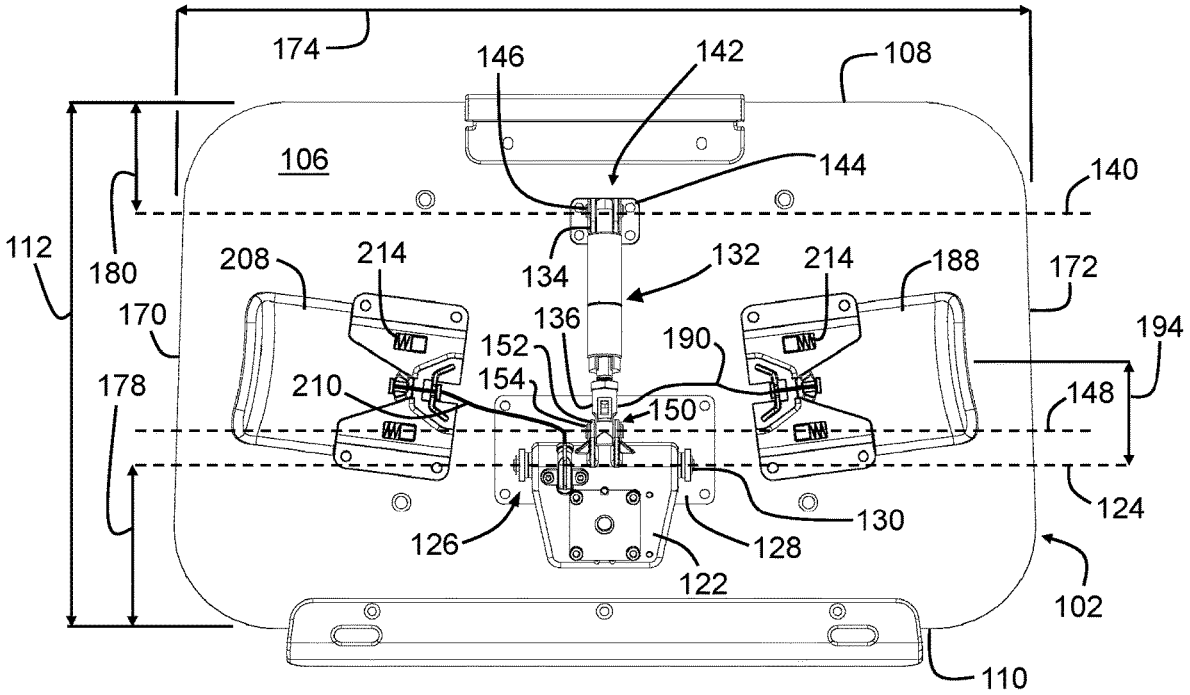
Figure 7:
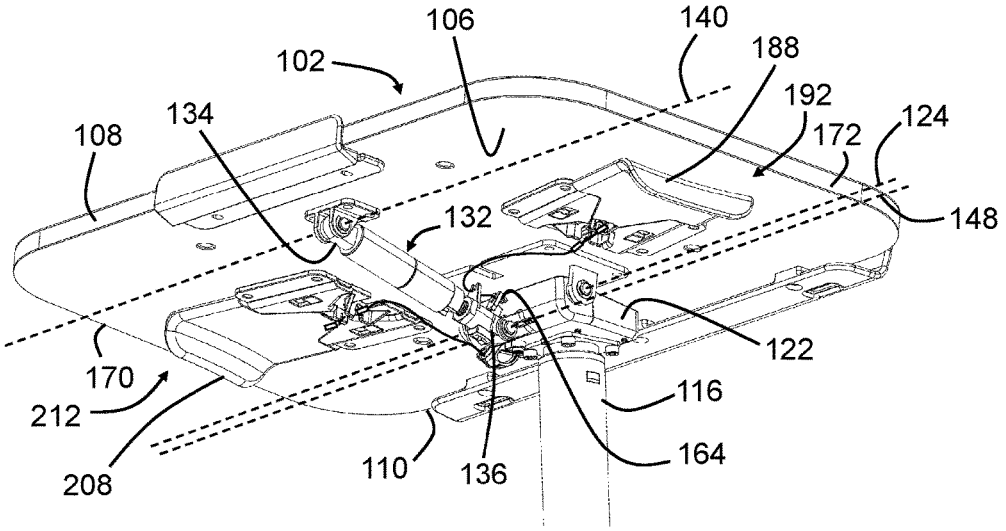
Figure 8:
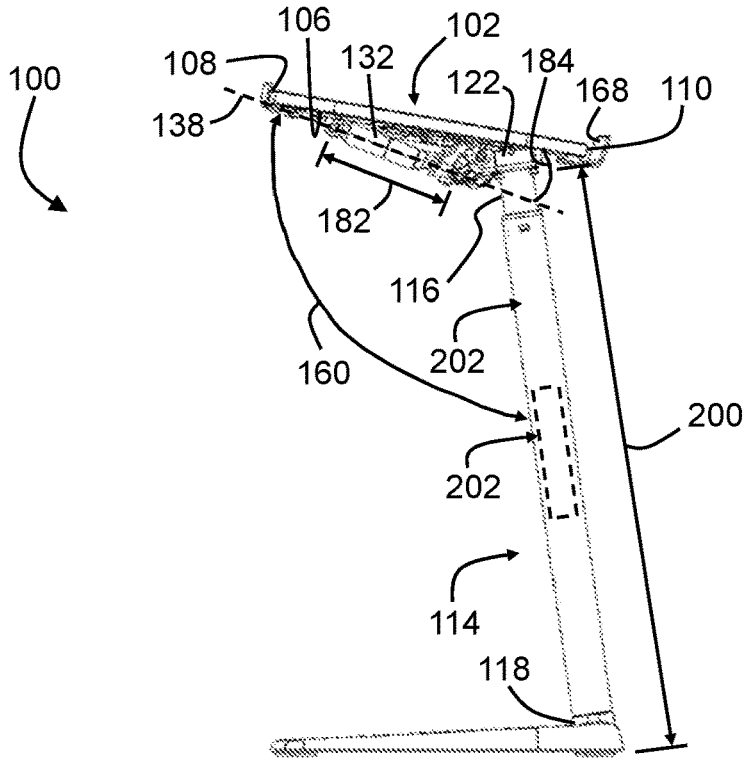
Figure 9:
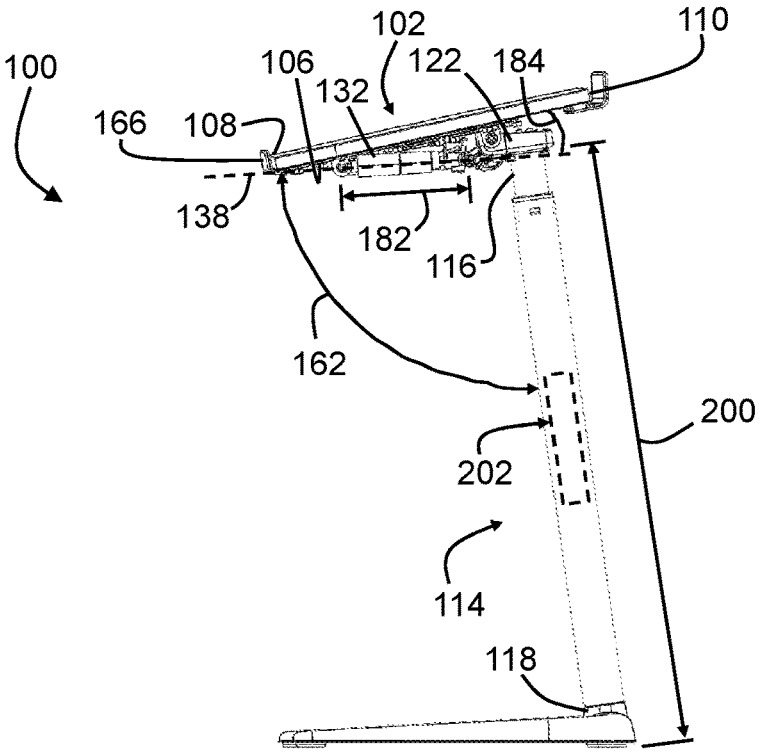
Figure 10:
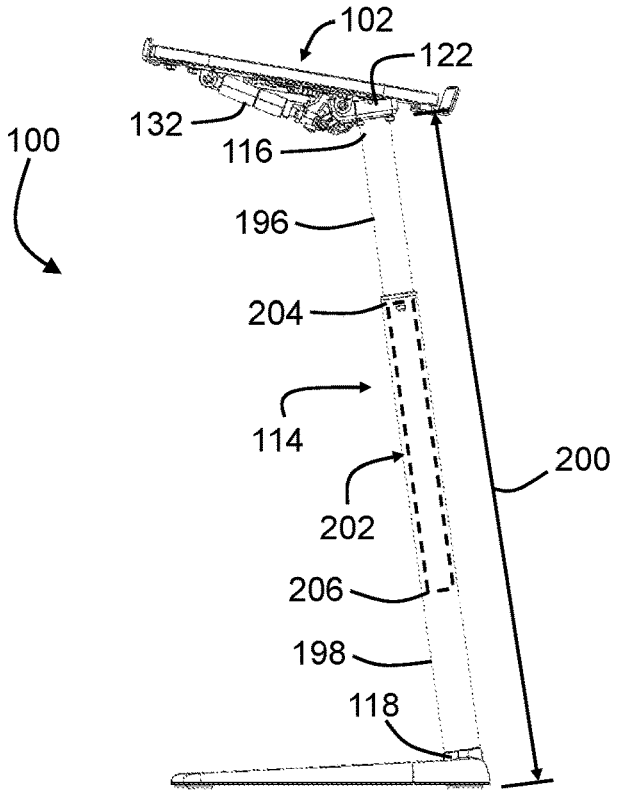
Figure 11:
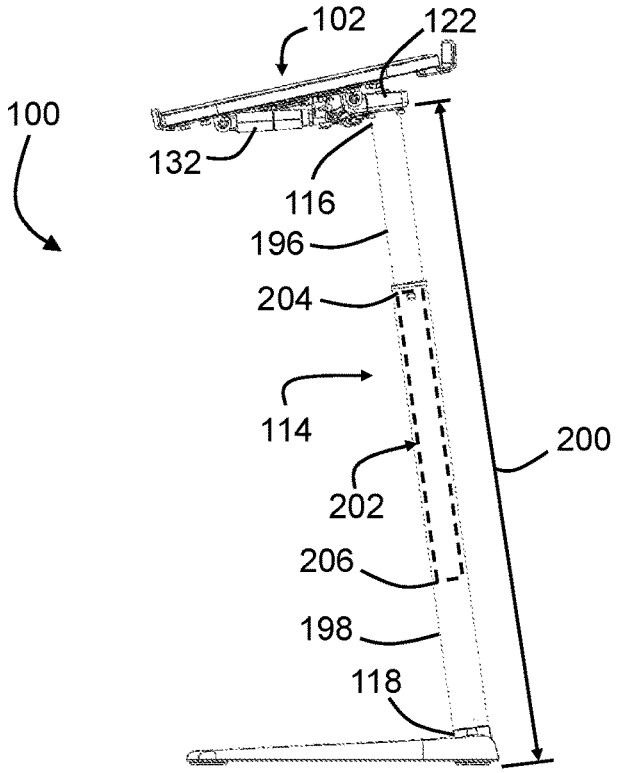

FIG. 5*a* is an enlarged view of a portion of the adjustable workstation identified at box 5*a* of FIG. 5;

FIG. 6 is a bottom view of a portion of the adjustable workstation of FIG. 1;

FIG. 7 is a perspective view of an upper portion of the adjustable workstation of FIG. 1;

FIG. 8 is a side view of the adjustable workstation of FIG. 1, with the tabletop in a front edge raised position and the leg fully retracted;

FIG. 9 is a side view of the adjustable workstation of FIG. 1, with the tabletop in a front edge lowered position and the leg fully retracted;

FIG. 10 is a side view of the adjustable workstation of FIG. 1, with the tabletop in a front edge raised position and the leg fully extended; and FIG. 11 is a side view of the adjustable workstation of FIG. 1, with the tabletop in a front edge lowered position and the leg fully extended.

The drawings included herewith are for illustrating various examples of apparatuses and methods of the teaching of the present specification and are not intended to limit the scope of what is taught in any way.

DESCRIPTION OF VARIOUS EXAMPLES

Various apparatuses or processes will be described below to provide an example of each claimed invention. No example described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an example of any claimed invention. Any invention disclosed in an apparatus or process described below that is not claimed in this document may be the subject matter of another protective instrument, for example, a continuing patent application, and the applicants, inventors, or owners do not intend to abandon, disclaim, or dedicate to the public any such invention by its disclosure in this document.

Referring to FIGS. 1-4, an adjustable workstation 100 includes a tabletop 102 and a leg 114 for supporting the tabletop 102. As disclosed in more detail subsequently herein, the tabletop 102 is pivotably coupled to the leg 114 so that the inclination of the tabletop 102 can be adjusted according to its user's needs. In use, the tabletop 102 may be used to support one or more user items (e.g., a laptop computer, a tablet computer, a notepad for writing, a speech, etc.). For example, a user may prefer the tabletop 102 at one inclination when using their laptop and another inclination when writing in a notepad.

Figure 4:
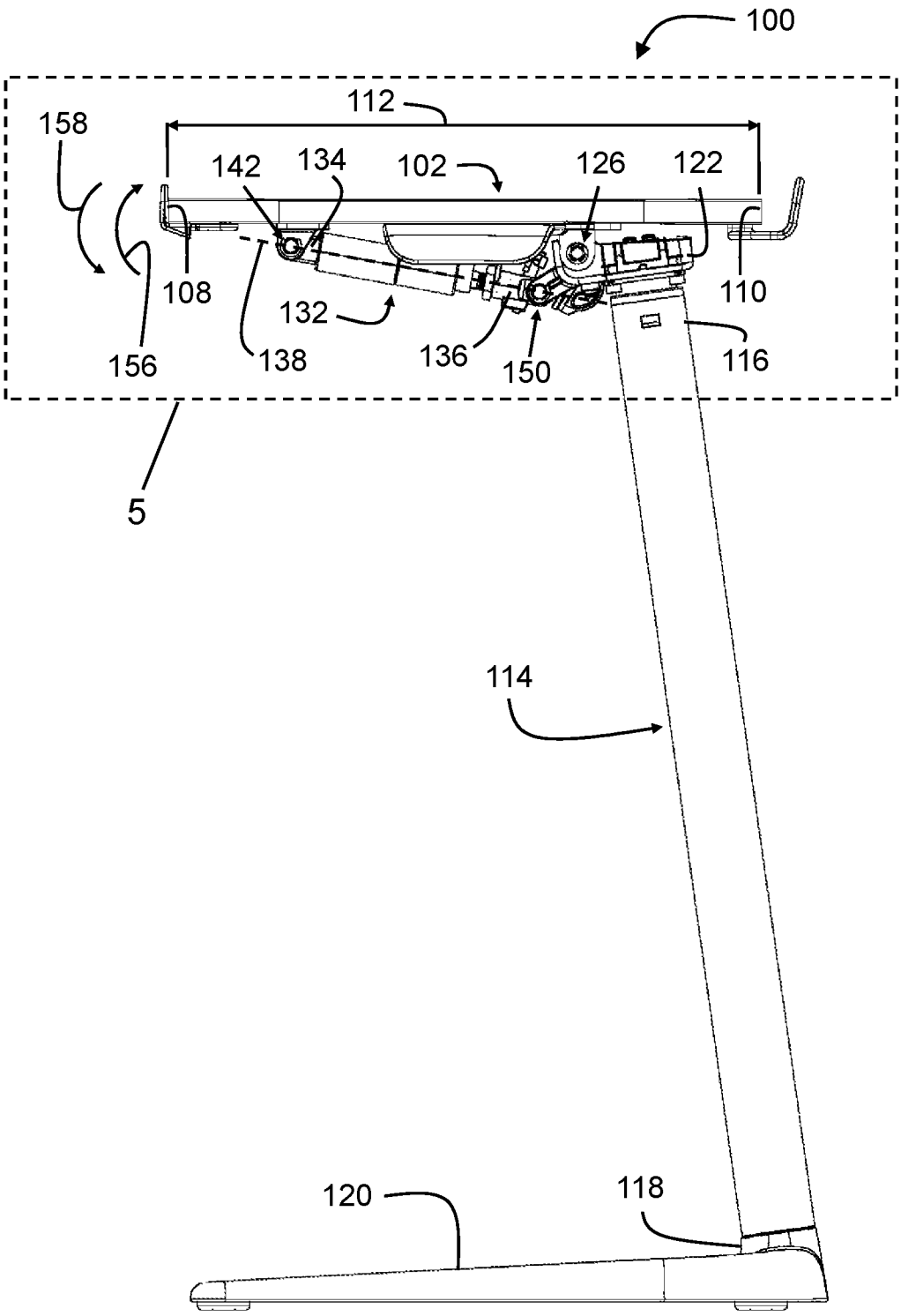
FIG. 4 is a side view of the adjustable workstation of FIG. 1.

The tabletop 102 has a tabletop upper surface 104, a tabletop underside surface 106 opposite the tabletop upper surface 104. With reference to FIG. 4, the tabletop 102 also a tabletop front edge 108, and a tabletop rear edge 110 spaced rearwardly from the tabletop front edge 108 by a tabletop depth 112.

Referring still to FIG. 4, the leg 114 includes a leg upper end portion 116 and a leg lower end portion 118. In the illustrated example, the leg 114 extends upwardly and forwardly from the leg lower end portion 118 to the leg upper end portion 116 so that, in use, the leg upper end portion 116 is located generally forwardly of the leg lower end portion 118. This may provide additional room for a user's legs and/or feet under the tabletop 102 compared to a workstation with a leg that extends perpendicularly relative to the floor.

Figure 2:
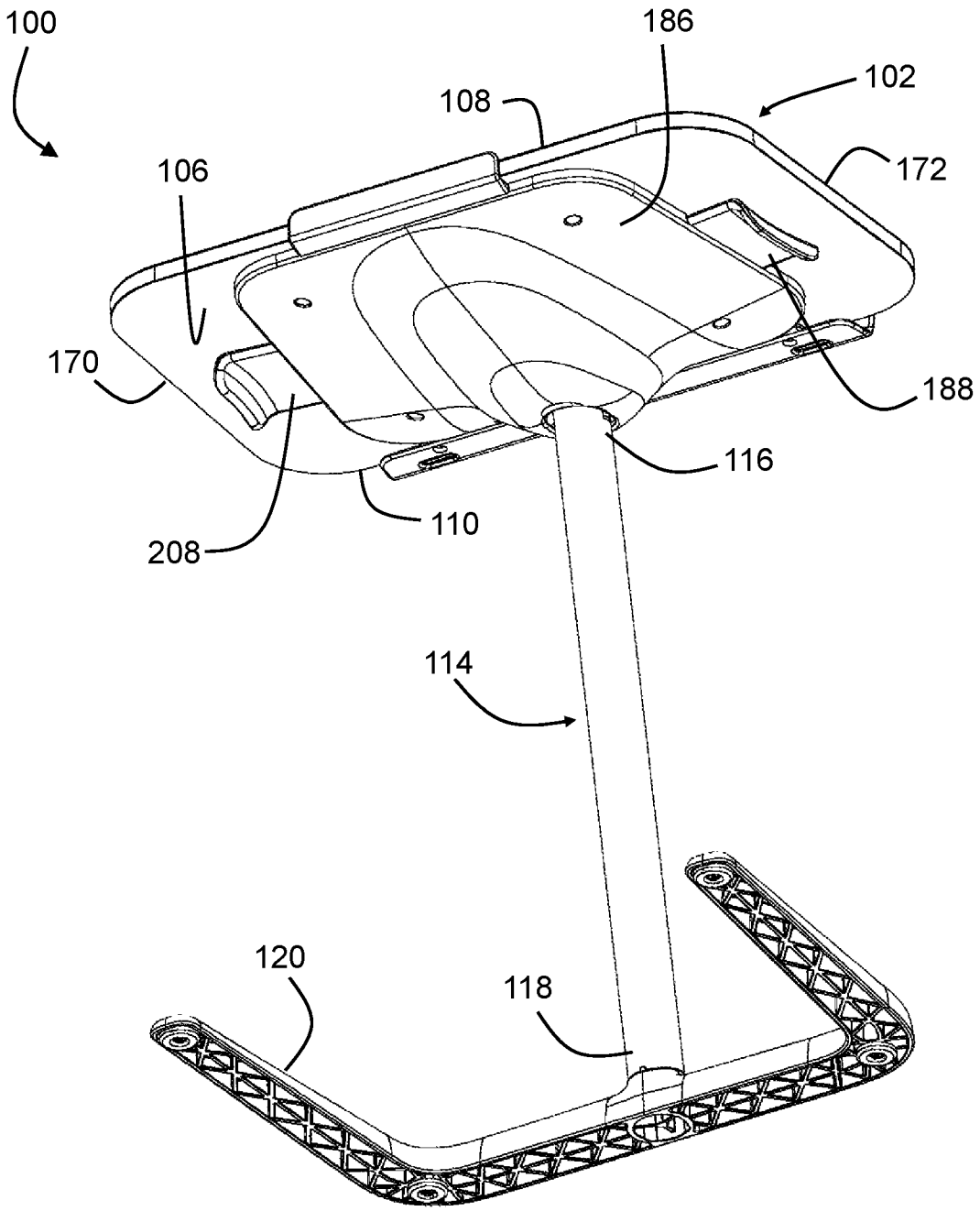
FIG. 2 is a bottom perspective view of the adjustable workstation of FIG. 1.

Referring to FIGS. 1 and 2, the leg lower end portion 118 includes a floor base 120 for engaging the floor. The floor base 120 can have any form capable of maintaining the workstation 100 in an upright position. In the illustrated example, the floor base 120 is in the form of a U-shaped base. The U-shaped base provides a stable engagement with the floor and space between opposed prongs for the user's feet.

Referring to FIGS. 5 and 5*a*, the adjustable workstation 100 further includes a tabletop mount 122 affixed to the leg upper end portion 116. As described in more detail subsequently herein, the tabletop mount 122 includes mounting features for connecting the tabletop mount 122 to the tabletop 102 and a gas spring 132. The tabletop mount 122 can be affixed to the leg upper end portion 116 in any manner that does not allow the leg 114 and the tabletop mount 122 to move relative to one another. In the illustrated example, the tabletop mount 122 is rigidly fixed to the leg upper end portion with mechanical fasteners. Alternatively, the tabletop mount 122 may be integrally formed with the leg upper end portion 116. For example, the leg 114 and the tabletop mount 122 may be of unitary construction or welded together.

Referring to FIGS. 6 and 7, the tabletop mount 122 is pivotably coupled to the tabletop underside surface 106 at a tabletop tilt axis 124. The tabletop 102 is pivotable relative to the tabletop mount 122 about the tabletop tilt axis 124. In the illustrated example, the tabletop tilt axis 124 is spaced forwardly of the leg upper end portion 116. This arrangement may provide additional space beneath the tabletop 102 for the user's legs and/or feet compared to arrangements in which the leg upper end portion 116 is spaced forwardly of the tabletop tilt axis 124.

The tabletop mount 122 can be coupled to the tabletop underside surface 106 in any manner that allows the tabletop 102 to pivot relative to the tabletop mount 122. Referring to FIGS. 5*a* and 6, in the illustrated example, the tabletop underside surface 106 is pivotably coupled to the tabletop mount 122 by a clevis joint 126. The clevis joint 126 includes a clevis plate 128 and a clevis pin 130 that passes through a pin aperture formed in the tabletop mount 122. The clevis plate 128 is mounted to the tabletop underside surface 106 and has holes in each prong to receive opposed ends of the clevis pin 130.

Referring again to FIGS. 4 and 5, the adjustable workstation 100 further includes a tabletop gas spring 132 that can assist pivoting the tabletop 102 about the tabletop tilt axis 124 (FIG. 7). The gas spring 132 has a gas spring front end portion 134 and a gas spring rear end portion 136 spaced apart from the gas spring front end portion 134 along a gas spring axis 138.

Referring to FIG. 7, the gas spring front end portion 134 is pivotably coupled to the tabletop underside surface 106 at a gas spring front axis 140. The gas spring front end portion 134 can be pivotably coupled to the tabletop underside surface 106 in any suitable manner. Referring to FIGS. 5 and 6, in the illustrated example, the gas spring front end portion 134 is pivotably coupled to the tabletop underside surface 106 by a clevis joint 142. The clevis joint 142 includes a clevis plate 144 and a clevis pin 146 that passes through a pin aperture in the gas spring front end portion 134. The clevis plate 144 is fixed to the tabletop underside surface 106 and has holes in each prong to receive opposed ends of the clevis pin 146.

Referring to FIGS. 5*a* and 7, the gas spring rear end portion 136 is pivotably coupled to the tabletop mount 122 at a gas spring rear axis 148. The gas spring rear axis 148 is located below (i.e., at an elevation lower than) the tabletop tilt axis 124. The gas spring rear end portion 136 can be pivotably coupled to the tabletop mount 122 in any suitable manner.

With reference to FIGS. 5*a* and 6, in the illustrated example, the gas spring rear end portion 136 is pivotably coupled to the tabletop mount 122 by a clevis joint 150. The clevis joint 150 includes a clevis member 152 and a clevis pin 154 that passes through a pin aperture in the gas spring rear end portion 136. The clevis member 152 extends downwardly from a lower end of the tabletop mount 122 and has holes in each prong to receive opposed ends of the pin 154. The downwardly extending clevis body 152 spaces the gas spring rear axis 148 downwardly of the tabletop tilt axis 124. In the illustrated example, the clevis member 152 extends forwardly and downwardly from the lower end of the tabletop mount 122 and spaces the gas spring rear axis 148 both forwardly and downwardly of the tabletop tilt axis 124.

The clevis member 152 can be fixed to the lower end of the tabletop mount 122 in any way that prevents the clevis member 152 from moving relative to the tabletop mount 122. In the illustrated example, the clevis member 152 is welded onto the lower end of the tabletop mount 122. In alternative examples, the clevis member 152 and the tabletop mount 122 may be of unitary construction.

With reference to FIGS. 5 and 7, the tabletop 102 is configured to pivot in a first direction of rotation 156 (i.e., clockwise from the perspective in FIG. 5) about the tabletop tilt axis 124 upon extension of the gas spring 132 to raise the tabletop front edge 108 relative to the tabletop rear edge 110. The tabletop 102 is configured to pivot in a second direction of rotation 158 (i.e., counterclockwise from the perspective in FIG. 5) about the tabletop tilt axis 124 upon retraction of the tabletop gas spring 132 to lower the tabletop front edge 108 relative to the tabletop rear edge 110.

Referring to FIG. 5*a*, the adjustable workstation 100 further includes a gas spring lock 164 movable between a locked position, in which the gas spring lock 164 inhibits extension and retraction of the tabletop gas spring 132, and an unlocked position, in which extension and retraction of the tabletop gas spring 132 is uninhibited by the gas spring lock 164. To adjust the inclination of the tabletop 102, the gas spring lock 164 is moved to an unlocked position and, with the gas spring lock 164 in the unlocked position, an external force is supplied to the tabletop 102 that pivots the tabletop 102 about the tabletop tilt axis 124 in the desired direction (e.g., in the first direction of rotation 156 or the second direction of rotation 158). The gas spring lock 164 is returned to the locked position once the tabletop 102 reaches the desired inclination.

The gas spring 132 is movable between fully extended and fully retracted positions. FIG. 8 illustrates an exemplary embodiment where the gas spring 132 of the workstation 100 is in the fully extended position. When the gas spring 132 is in the fully extended position, the tabletop 102 is pivoted about the tabletop tilt axis 124 to a front edge raised position, with the tabletop 102 inclined at a maximum tilt angle 160 relative to the leg 114. In the illustrated example, the tabletop front edge 108 is at a higher elevation than the tabletop rear edge 110 when the tabletop 102 is in the front edge raised position.

FIG. 9 illustrates an exemplary embodiment where the gas spring 132 of the workstation 100 is in the fully retracted position. When the gas spring 132 is in the fully retracted position, the tabletop 102 is pivoted about the tabletop tilt axis 124 to a front edge lowered position, with the tabletop 102 inclined at a minimum tilt angle 162 relative to the leg 114. The tabletop front edge 108 is at a lower elevation than the tabletop rear edge 110 when the tabletop 102 is in the front edge lowered position.

Comparing FIG. 9 to FIG. 8, the minimum tilt angle 162 is smaller than the maximum tilt angle 160. In some examples, the maximum tilt angle 160 is between 80 and 130 degrees. In some examples, the minimum tilt angle 162 is between 45 and 90 degrees. In the illustrated example, the maximum tilt angle 160 is about 120 degrees and the minimum tilt angle 162 is about 85 degrees. These maximum and minimum tilt angles 160, 162 and the range of tilt angles therebetween are well suited for the majority of workstation uses.

In some examples, the tabletop 102 pivots between 20 and 50 degrees about the tabletop tilt axis 124 when the tabletop gas spring 132 is moved from the fully retracted position to the fully extended position. In the illustrated example, the tabletop 102 pivots approximately 35 degrees about the tabletop tilt axis 124 when the tabletop gas spring 132 is moved from the fully retracted position to the fully extended position.

The gas spring 132 is configured to exert a biasing force into extension. In the illustrated example, the biasing force assists pivoting the tabletop 102 in the first direction of rotation 156 to raise the tabletop front edge 108. The gas spring 132 includes a gas-tight cylinder and an internal piston movable along the cylinder. The cylinder is filled with a compressed gas (e.g., nitrogen) that produces a spring force urging the piston to extend from the cylinder. The piston has a distal end portion retained within the cylinder and a proximal end portion that projects outwardly from the cylinder. The distal end portion of the piston has a through hole which allows the compressed gas to move between opposite sides of the distal end portion as the piston extends or retracts within the cylinder. As a result, the compressed gas acts on both sides of the distal end portion of the piston. On a first side of the distal end portion, the compressed gas exerts an extending force on the piston. On a second side of the distal end portion, the compressed gas exerts a retracting force on the piston. The extending force is greater than the retracting force because the piston takes up some of the area on the second side of the distal end portion. This allows the compressed gas to exert an almost constant extending force on the piston throughout its entire stroke.

Referring to FIG. 1, the tabletop 102 includes optional front and rear retainment ledges 166, 168 to help hold user items on the tabletop upper surface 104. In the illustrated example, the front retainment ledge 166 extends along a portion of the tabletop front edge 108 and projects upwardly past the tabletop upper surface 104. In cases where the tabletop front edge 108 is at a higher elevation than the tabletop rear edge 110 (e.g., FIG. 9), the front retainment ledge 166 can help hold a user object on the tabletop 102 instead of gravity causing it to slide off the tabletop front edge 108. In the illustrated example, the rear retainment ledge 168 extends along a portion of the tabletop rear edge 110 and projects upwardly past the tabletop upper surface 104. In cases where the tabletop front edge 108 is at a lower elevation than the tabletop rear edge 110 (e.g., FIG. 8), the rear retainment ledge 168 can help hold a user object on the tabletop 102 instead of gravity causing it to slide off the tabletop rear edge 110.

Figure 3:
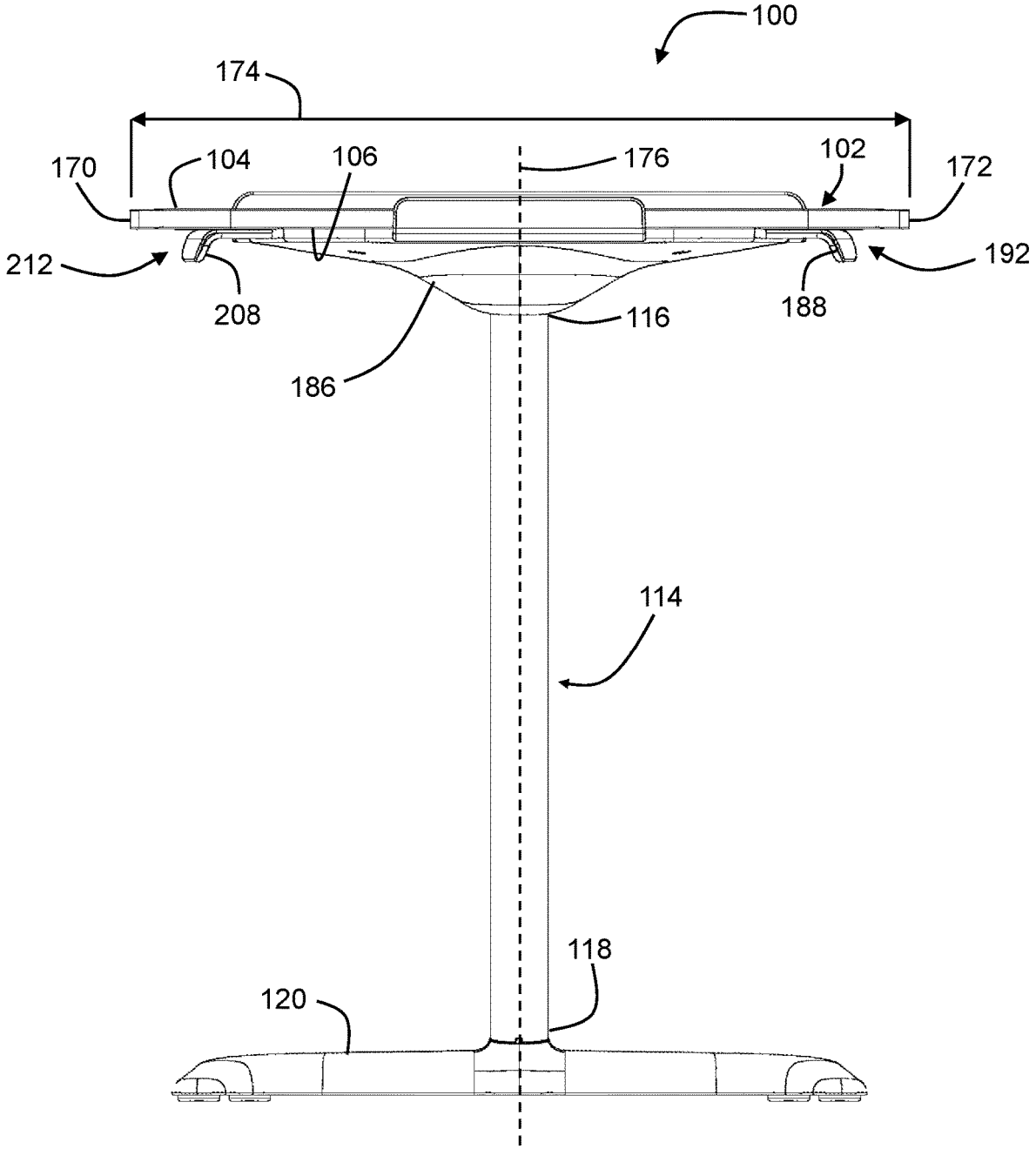
FIG. 3 is a front view of the adjustable workstation of FIG. 1.

Referring to FIG. 3, the tabletop 102 has a tabletop first side edge 170 and a tabletop second side edge 172 spaced laterally from the tabletop first side edge 170 by a tabletop width 174. The leg 114 has a leg axis 176 extending centrally through the leg upper end portion 116 and the leg lower end portion 118. Single leg workstations where the leg 114 is centrally located along the tabletop width 174 are generally more stable than those where the leg is not centrally located. From a stability perspective, the leg axis 176 preferably intersects the tabletop 102 at a point spaced laterally from the tabletop first side edge 170 by 40% to 60% of the tabletop width 174. In the illustrated example, the leg axis 176 intersects the tabletop 102 at a midpoint of the tabletop width 174 so that the weight of the tabletop 102 is balanced on both sides of the leg axis 176.

Reference is now made to FIG. 6. The leg 114 is omitted from FIG. 6 for clarity of illustration. The tabletop tilt axis 124 is located rearwardly of a midpoint of the tabletop depth 112. By locating the tabletop tilt axis 124 rearward of the midpoint of the tabletop depth 112, the center of mass of the tabletop 102 is located forwardly of the tabletop tilt axis 124. Such an arrangement may make it easier for a user located forward of the tabletop front edge 108 to pivot the tabletop 102 about the tabletop tilt axis 124 since the center of mass is between the user and the tabletop tilt axis 124. In the illustrated example, the tabletop tilt axis 124 is spaced forwardly of the tabletop rear edge 110 by a forward offset 178. The forward offset 178 is preferably less than 40% of the tabletop depth 112. More preferably, the forward offset 178 is between 10% and 40% of the tabletop depth 112. In the illustrated example, the forward offset 178 is about 33%. The forward offset 178 may improve safety of the workstation 100 by spacing the tabletop tilt axis 124 (i.e., a pinch point) away from the tabletop rear edge 110.

The gas spring front axis 140 is located forwardly of the tabletop tilt axis 124. In the illustrated example, the gas spring front axis 140 is located forwardly of the midpoint of the tabletop depth 112. The gas spring front axis 140 is, in the illustrated example, spaced rearwardly of the tabletop front edge 108 by a rearward offset 180. The rearward offset 180 is preferably less than 30% of the tabletop depth 112. More preferably, the rearward offset 180 is between 10% and 25% of the tabletop depth 112. Since the rearward offset 180 locates the gas spring front end 134 away from tabletop front edge 108, it clears the gas spring 132 from an area beneath the tabletop 102 that may be occupied by the user's knees during seated use. The rearward offset 180 may also improve safety of the workstation 100 by spacing the gas spring front axis 140 (i.e., a pinch point) away from the tabletop front edge 108.

Referring to FIGS. 2 and 3, the adjustable workstation 100 further includes an optional cover 186 affixed to the tabletop underside surface 106 to conceal at least the tabletop gas spring 132. In the illustrated example, the cover 186 also conceals the tabletop mount 122. The cover 186 may provide one or more advantages. For example, the cover 186 can improve safety by blocking user access to the gas spring 132 and/or the tabletop mount 122 (i.e., potential pinch points are covered). Alternatively, or in addition, the cover 186 may protect the gas spring 132 and the tabletop mount 122 from damage and/or impede tampering. The cover 186 is omitted from FIGS. 4 to 7 to illustrate internal components that would otherwise be hidden by the cover 186.

Referring to FIG. 5, the tabletop gas spring 132 has a gas spring length 182 between the gas spring front end portion 134 and the gas spring rear end portion 136. The gas spring length 182 increases upon expansion of the gas spring 132 and decreases upon retraction of the has spring 132. The gas spring axis 138 is inclined at a gas spring angle 184 relative to the tabletop underside surface 106. The adjustable workstation 100 advantageously offers a wide range of tabletop tilt angles while limiting changes to the gas spring length 182 and the gas spring angle 184. These advantages stem from the way in which the gas spring 132 is oriented relative to the tabletop 102 and the tabletop mount 122 (i.e., the gas spring rear axis 148 located at an elevation lower than the tabletop tilt axis 124, and the gas spring front axis 140 located forwardly of the tabletop tilt axis 124). Keeping changes to the gas spring length 182 and the gas spring angle 184 small during tilt adjustments can help simplify the tilt adjustment (i.e., less overall movement of the gas spring 132 is needed to accomplish a tilt adjustment). Limiting changes to the gas spring length 182 and the gas spring angle 184 also allows for a compact design that can be located below the tabletop 102 and optional concealed by the cover 186.

Preferably, the gas spring length 182 increases by less than 15% when the gas spring 132 is moved from the fully retracted position to the fully extended position. In the illustrated example, the gas spring length 182 increases by 10% when the gas spring 132 is moved from the fully retracted position (FIG. 9) to the fully extended position (FIG. 8). This is a relatively small increase in the gas spring length 182 considering the tabletop 102 pivots by approx. 30 degrees about the tabletop tilt axis 124 when the gas spring 132 is moved from the fully retracted position to the fully extended position.

The gas spring angle 184 preferably changes by less than 15 degrees when the gas spring 132 is moved between the fully extended position and the fully retracted position. In the illustrated example, the gas spring angle 184 changes by approx. 10 degrees when the gas spring 132 is moved between the fully extended position (FIG. 8) and the fully retracted position (FIG. 9). This is a relatively small change in the gas spring angle 184 considering the tabletop 102 pivots by approx. 30 degrees about the tabletop tilt axis 124 when the gas spring 132 is moved from the fully retracted position to the fully extended position.

Referring to FIG. 8, the gas spring angle 184 is preferably between 10 and 35 degrees when the gas spring 132 is in the fully extended position. More preferably, the gas spring angle 184 is between 15 and 30 degrees when the gas spring 132 is in the fully extended position. When the gas spring angle 184 is less than 35 degrees, the gas spring 132 is considered proximate the tabletop underside surface 106 and thereby out of the user's way. In the illustrated example, the gas spring angle 184 is approx. 20 degrees when the gas spring 132 is in the fully extended position. Comparing FIG. 8 to FIG. 9, the gas spring angle 184 decreases when the gas spring 132 is moved from the fully extended position (FIG. 8) to the fully retracted position (FIG. 9). In the illustrated example, the gas spring axis 184 is about 10 degrees when the gas spring 132 is in the fully retracted position.

Referring again FIGS. 5 and 6, in the illustrated example, the adjustable workstation 100 further includes a user-operable lock release actuator 188 coupled to the gas spring lock 164. The lock release actuator 188 is, in the illustrated example, mounted to the tabletop underside surface 106 and located forwardly of the tabletop tilt axis 124 (FIG. 6).

The lock release actuator 188 is movable between a first position and second position. In the illustrated example, the lock release actuator 188 is biased to the first position (e.g., by coil springs 214). Moving the lock release actuator 188 from the first position to the second position causes the gas spring lock 164 to move from the locked position to the unlocked position. The lock release actuator 188 is, in the illustrated example, coupled to the gas spring lock 164 by a cord 190. Moving the lock release actuator 188 from the first position to the second position pulls the cord 190, which moves the gas spring lock 164 from the locked position to the unlocked position.

In the illustrated example, the lock release actuator 188 is in the form of a paddle that can be actuated (i.e., pulled) with the user's fingers toward the tabletop second side edge 172 to move it from the first position to the second position. The springs 214 urge the paddle back to the first position once the user's fingers are released from the paddle. In alternative examples, the lock release actuator 188 is not biased to the first position, and the user is required to supply an external force to the lock release actuator 188 to move it from the second position to the first position.

In the illustrated example, the lock release actuator 188 is positioned proximate the tabletop second side edge 172. With the lock release actuator 188 positioned proximate the tabletop second side edge 172, the lock release actuator 188 and a portion of the tabletop upper surface 104 above the lock release actuator 188 form a hand grip 192 (see FIGS. 3 and 7). The hand grip 192 allows a user to sequentially i) move the lock release actuator 188 from the first position to the second position and ii) supply an upward or downward force to the tabletop 102 to pivot the tabletop 102 about the tabletop tilt axis 124 with a single hand. Alternatively, the user may elect to use two hands to pivot the tabletop 102 about the tabletop tilt axis 124 (i.e., one hand to move the lock release actuator 188 from the first position to the second position and another hand to supply an upward or downward force to the tabletop 102 to pivot the tabletop 102 about the tabletop tilt axis 124).

Since the lock release actuator 188 is mounted to the tabletop underside surface 106, the lock release actuator 188 and the tabletop 102 move as one. The closer the lock release actuator 188 is to the tabletop tilt axis 124, the less the lock release actuator 188 travels as the tabletop 102 pivots about the tabletop tilt axis 124. Referring to FIG. 6, a midpoint of the lock release actuator 188 is spaced forwardly of the tabletop tilt axis 124 by an actuator offset 194. The actuator offset 194 is preferably less than 15 cm. More preferably, the actuator offset 194 is less than 10 cm. In the illustrated example, one of the user's hands must hold the lock release actuator 188 in the second position as the tabletop 102 pivots about the tabletop tilt axis 124. Consequently, positioning the lock release actuator 188 immediately adjacent to the tabletop tilt axis 124 shortens the travel path of the user's hand as the tabletop 102 pivots about the tabletop tilt axis 124.

Referring to FIGS. 10 and 11, the workstation 100 includes optional features that facilitate elevation adjustments of the tabletop 102. In the illustrated example, the leg 114 includes a leg upper segment 196 and a leg lower segment 198 telescopically connected to the leg upper segment 196. The leg upper segment 196 has the leg upper end portion 116. The leg lower segment 198 has the leg lower end portion 118. In the illustrated example, the leg upper segment 196 telescopes within the leg lower segment 198. In alternative examples, the leg lower segment 198 telescopes within the leg upper segment 196.

The leg 114 has a leg length 200 from the leg upper end portion 116 to the leg lower end portion 118. The leg upper segment 196 is moveable relative to the leg lower segment 198 to vary the leg length 200. The leg length 200 can be varied to adjust the elevation of the tabletop 102. In alternative examples, the leg 114 includes a single elongate part that extends continuously between the leg upper end portion 116 and leg lower end portion 118 (i.e., is not made up of multiple segments).

In the illustrated example, the adjustable workstation 100 further includes a leg gas spring 202 disposed within the leg 114 to assist with moving the leg upper segment 196 relative to the leg lower segment 198. The gas spring 202 extends between a gas spring upper end portion 204 coupled to the leg upper segment 196 and a gas spring lower end portion 206 coupled to the leg lower segment 198.

The leg length 200 increases upon extension of the gas spring 202 to raise the tabletop 102 relative to the floor. The leg length 200 decreases upon retraction of the gas spring 202 to lower the tabletop 102 relative to the floor. The gas spring 202 is movable between a fully extended position and a fully retracted position.

FIGS. 8 and 9 illustrate an exemplary embodiment where the gas spring 202 of the workstation is in the fully retracted position. When the gas spring 202 is in the fully retracted position, the tabletop 102 is at a minimum elevation. FIGS. 10 and 11 illustrate an exemplary embodiment where the gas spring 202 of the workstation 100 is in the fully extended position. When the gas spring 202 is in the fully extended position, the tabletop 102 is at a maximum elevation.

In the same manner as the tabletop gas spring 132, the leg gas spring 202 is configured to exert a biasing force into extension. In the illustrated example, the biasing force assists increasing the leg length 200 (i.e., the biasing force helps the user raise the tabletop 102 relative to the floor).

The adjustable workstation 100 further includes a leg gas spring lock (not shown) movable between a locked position, in which the leg gas spring lock inhibits extension and retraction of the gas spring 202, and an unlocked position, in which extension and retraction of the gas spring 202 is uninhibited. To adjust the elevation of the tabletop 102, the leg gas spring lock is moved to an unlocked position and, with the leg gas spring lock in the unlocked position, an external force is supplied to the tabletop 102 that moves the tabletop 102 in the desired direction (i.e., an upward force to increase the elevation or a downward force to decrease the elevation). The leg gas spring lock is returned to the locked position once the tabletop 102 reaches the desired elevation.

Referring to FIGS. 6 and 7, in the illustrated example, the adjustable workstation 100 further includes a user-operable lock release actuator 208 coupled to the leg gas spring lock. The lock release actuator 208 is, in the illustrated example, mounted to the tabletop underside surface 106 and located forwardly of the tabletop tilt axis 124 (FIG. 6).

The lock release actuator 208 is movable between a first position and second position. Referring to FIG. 6, in the illustrated example, the lock release actuator 208 is biased to the first position (e.g., by coil springs 214). Moving the lock release actuator 208 from the first position to the second position causes the leg gas spring lock to move from the locked position to the unlocked position. In the illustrated example, the lock release actuator 208 is coupled to the leg gas spring lock by a cord 210. Moving the lock release actuator 208 from the first position to the second position pulls the cord 210, which moves the leg gas spring lock from the locked position to the unlocked position.

In the illustrated example, the lock release actuator 208 is in the form of a paddle that can be actuated (i.e., pulled) by the user's fingers toward the tabletop first side edge 170 to move it from the first position to the second position. The springs 214 urge the paddle back to the first position once the user's fingers are released from the paddle. In alternative examples, the lock release actuator 208 is not biased to the first position, and the user is required to supply an external force to the lock release actuator 208 to move it from the second position to the first position.

In the illustrated example, the lock release actuator 208 is positioned proximate the tabletop first side edge 170. With the lock release actuator 208 positioned proximate the tabletop second side edge 172, the lock release actuator 208 and a portion of the tabletop upper surface 104 above the lock release actuator 208 form a hand grip 212 (see FIGS. 3 and 7). The hand grip 212 allows a user to sequentially i) move the lock release actuator 208 from the first position to the second position and ii) supply an upward or downward force to the tabletop 102 to vary the leg length 200 with a single hand. Alternatively, the user may elect to use two hands to adjust the elevation of the tabletop 102 (i.e., one hand to move the lock release actuator 208 from the first position to the second position and another hand to supply an upward or downward force to the tabletop 102 to vary the leg length 200).

In the illustrated example, each of the hand grips 192, 212 are engageable by a respective one of the user's hands to facilitate simultaneous or sequential elevation and inclination adjustments of the tabletop 102. This can allow the user to quickly adjust the tabletop 102 into the desired position.

What has been described above is intended to be illustrative of examples of the teaching disclosed herein, without limiting the scope of patent claims granted herefrom. The scope of such claims should be given the broadest interpretation consistent with the description as a whole.

The invention claimed is:

1. An adjustable workstation comprising:

a) a tabletop having a tabletop upper surface, a tabletop underside surface opposite the tabletop upper surface, a tabletop front edge, and a tabletop rear edge spaced rearwardly from the tabletop front edge by a tabletop depth;

b) a leg for supporting the tabletop, the leg comprising a leg upper end portion and a leg lower end portion;

c) a tabletop mount affixed to the leg upper end portion, wherein the tabletop mount is pivotably coupled to the tabletop underside surface at a tabletop tilt axis, the tabletop tilt axis being located rearwardly of a midpoint of the tabletop depth, wherein the tabletop pivots relative to the tabletop mount about the tabletop tilt axis;

d) a tabletop gas spring having a gas spring front end portion and a gas spring rear end portion spaced apart from the gas spring front end portion along a gas spring axis, the gas spring front end portion being pivotably coupled to the tabletop underside surface at a gas spring front axis, the gas spring rear end portion being pivotably coupled to the tabletop mount at a gas spring rear axis, the gas spring front axis being located forwardly of the tabletop tilt axis, the gas spring rear axis being located below the tabletop tilt axis, wherein the tabletop is configured to pivot in a first direction of rotation about the tabletop tilt axis upon extension of the tabletop gas spring to raise the tabletop front edge relative to the tabletop rear edge, and wherein the tabletop is configured to pivot in a second direction of rotation about the tabletop tilt axis upon retraction of the tabletop gas spring to lower the tabletop front edge relative to the tabletop rear edge; and e) a gas spring lock movable between a gas spring locked position, in which the gas spring lock inhibits extension and retraction of the tabletop gas spring, and a gas spring unlocked position, in which extension and retraction of the tabletop gas spring is uninhibited by the gas spring lock.

2. The adjustable workstation of claim 1, wherein the tabletop tilt axis is spaced forwardly of the leg upper end portion.

3. The adjustable workstation of claim 1, wherein the tabletop tilt axis is spaced forwardly of the tabletop rear edge by a forward offset, the forward offset being between 10% and 40% of the tabletop depth.

4. The adjustable workstation of claim 1, wherein the gas spring front axis is located forwardly of the midpoint of the tabletop depth.

5. The adjustable workstation of claim 1, wherein the tabletop gas spring is configured to exert a biasing force into extension, wherein the biasing force assists pivoting the tabletop in the first direction of rotation to raise the tabletop front edge.

6. The adjustable workstation of claim 1, further comprising a user-operable lock release actuator coupled to the gas spring lock, wherein the lock release actuator is mounted to the tabletop underside surface and located forwardly of the tabletop tilt axis.

7. The adjustable workstation of claim 6, wherein:

the lock release actuator is movable between a first position and second position, the lock release actuator being biased to the first position, and moving the lock release actuator from the first position to the second position moves the gas spring lock from the gas spring locked position to the gas spring unlocked position.

8. The adjustable workstation of claim 7, wherein:

the tabletop has a tabletop first side edge and a tabletop second side edge spaced laterally from the tabletop first side edge by a tabletop width, and the lock release actuator is positioned proximate the tabletop second side edge whereby the lock release actuator and a portion of the tabletop upper surface above the lock release actuator form a user hand grip for sequentially i) moving the lock release actuator from the first position to the second position and ii) supplying an upward or downward force to the tabletop to pivot the tabletop about the tabletop tilt axis with one hand.

9. The adjustable workstation of claim 8, wherein a midpoint of the lock release actuator is spaced forwardly of the tabletop tilt axis by an actuator offset, the actuator offset being less than 15 cm.

10. The adjustable workstation of claim 1, wherein the tabletop pivots between 20 and 50 degrees about the tabletop tilt axis when the gas spring is moved from a fully retracted position to a fully extended position.

11. The adjustable workstation of claim 10, wherein the tabletop gas spring has a spring length from the gas spring front end portion to the gas spring rear end portion, and the spring length increases by less than 10% when the first gas spring is moved from the fully retracted position to the fully extended position.

12. The adjustable workstation of claim 1, wherein the gas spring axis is inclined at a gas spring angle relative to the tabletop underside surface, and the gas spring angle is between 10 and 35 degrees when the tabletop gas spring is in a fully extended position.

13. The adjustable workstation of claim 12, wherein the gas spring angle changes by less than 15 degrees when the tabletop gas spring is moved between the fully extended position and a fully retracted position.

14. The adjustable workstation of claim 1, further comprising a cover affixed to the tabletop underside surface for concealing at least the tabletop gas spring.

15. The adjustable workstation of claim 1, wherein the leg comprises a leg upper segment and a leg lower segment telescopically connected to the leg upper segment, the leg upper segment having the leg upper end portion, the leg lower segment having the leg lower end portion, the leg having a leg length from the leg upper end portion to the leg lower end portion, wherein the leg upper segment is moveable relative to the leg lower segment to vary the leg length.

16. The adjustable workstation of claim 15, further comprising a leg gas spring disposed within the leg to assist with moving the leg upper segment relative to the leg lower segment.

17. The adjustable workstation of claim 1, wherein the gas spring rear end portion is pivotably coupled to the tabletop mount by a clevis joint, the clevis joint located at a lower elevation than the tabletop tilt axis.

18. The adjustable workstation of claim 17, wherein the clevis joint comprises:

a pin passing through a pin aperture in the gas spring rear end portion, and a clevis member fixed to and extending downwardly from a lower end of the tabletop mount, the clevis member having opposed prong openings for receiving a respective end of the pin.

19. The adjustable workstation of claim 18, wherein the clevis member extends forwardly and downwardly from the lower end of the mount main body.

20. The adjustable workstation of claim 1, wherein:

the tabletop has a tabletop first side edge and a tabletop second side edge spaced laterally from the tabletop first side edge by a tabletop width; and the leg has a leg axis extending centrally through the leg upper end portion and the leg lower end portion, and the leg axis intersects the tabletop at a midpoint of the tabletop width.

* * * * *